United States Patent [19]

Saffer et al.

[11] Patent Number: 4,947,487

[45] Date of Patent: Aug. 14, 1990

[54] LASER BEAM PROTECTIVE GLOVES

[75] Inventors: Jeffrey D. Saffer; Louis A. Profenno, both of Ellsworth, Me.

[73] Assignee: The Jackson Laboratory, Bar Harbor, Me.

[21] Appl. No.: 347,069

[22] Filed: May 4, 1989

[51] Int. Cl.[5] ..... A41D 19/00

[52] U.S. Cl. ..... 2/167; 2/2; 2/161 R; 2/243 A

[58] Field of Search ..... 2/2, 158, 159, 164, 2/168, 243 A, 16, 161 R, 167; 350/98, 100, 109

[56] References Cited

U.S. PATENT DOCUMENTS

| | | | |
|---|---|---|---|
| 1,689,212 | 7/1928 | Picker | 2/161 R |
| 2,474,273 | 6/1949 | Olson | 2/167 |
| 2,737,597 | 3/1956 | Strobino | 2/161 R X |
| 4,355,424 | 10/1982 | McCoy, Jr. | 2/161 R |

FOREIGN PATENT DOCUMENTS

| | | | |
|---|---|---|---|
| 0038793 | 10/1981 | European Pat. Off. | 2/2 |
| 2444414 | 8/1980 | France | 2/161 R |
| 2021887 | 1/1987 | Japan | 2/243 A |

*Primary Examiner*—Werner H. Schroeder
*Assistant Examiner*—Sara M. Current
*Attorney, Agent, or Firm*—Daniel H. Kane

[57] ABSTRACT

A protective glove is formed of composite material for close fitting over the fingers and the back and palm of the hand. The composite material includes a layer of flexible elastic material for tactile sensitivity through the layer. Optically reflective and dispersive particles are distributed and embedded within the layer for dispersing incident laser light thereby preventing laser burn injuries to the hand of a wearer.

19 Claims, 1 Drawing Sheet

LASER BEAM PROTECTIVE GLOVES

The United States Government has rights in this invention by reason of research and development support under Department of Defense Office of Naval Research Laboratory Contract No. N00014-87-K-0145.

TECHNICAL FIELD

This invention relates to protective gloves such as latex, synthetic rubber, and plastic gloves for medical, laboratory and industrial uses. In particular the invention provides protective gloves for workers using lasers in medical, laboratory and industrial applications, for preventing laser burn injuries to the hand.

BACKGROUND ART

A laser beam passes without significant attenuation through conventional latex type gloves used in medical, laboratory and industrial procedures. Hands inadvertently passing through a laser beam are typically the site of laser injuries. In the case of medical laser surgery, the back of the hand is vulnerable to incident laser beams. In the case of laboratory sampling, the palm of the hand is often the site of laser burn injuries.

An important characteristic of conventional latex, synthetic rubber or plastic gloves is the tactile sensitivity which they afford during medical, laboratory or industrial procedures. A difficulty encountered in designing gloves to prevent laser burn injuries to the hand is that this tactile sensitivity may be degraded or lost. Thus, the prior art x-ray protective gloves incorporating leaded rubber or leaded plastic such as the Picker U.S. Pat. No. 1,689,212 and the McCoy U.S. Pat. No. 4,355,424 are entirely unsuited for such applications requiring tactile sensitivity. Furthermore, a simple reflective coating on the conventional latex gloves may result in dangerous reflections that may cause injuries to the eye.

OBJECTS OF THE INVENTION

It is therefore an object of the present invention to provide protective gloves that prevent laser burn injuries while maintaining tactile sensitivity for use in medical, laboratory and industrial procedures.

Another object of the invention is to provide latex, synthetic rubber or plastic type gloves which disperse laser beam energy without dangerous reflections.

DISCLOSURE OF THE INVENTION

In order to accomplish these results the invention provides a glove formed of composite material for close fitting over the fingers and the back and the palm of the hand. The composite material includes a layer of flexible elastic material such as latex, synthetic rubber or plastic for tactile sensitivity through the layer. According to the invention, optically reflective and dispersive particles are distributed and embedded within the layer for dispersing incident laser light, thereby preventing laser burn injuries to the hand of a wearer. A feature of the composite material is that it disperses the incident laser beam without dangerous reflections that might pose the risk of eye injury.

The optically reflective and dispersive particles distributed and embedded in the composite material layer may be formed of a variety of materials. For example metal filings may be used, preferably from a lighter weight metal such as aluminum. Alternatively, or in addition particles of mineral crystal grains for example of quartz or salts may be used or any of a variety of ceramic materials.

The preferred size range for the reflective and dispersive particles of the composite material is in the coarse powder to powder size range. For example, the optically dispersive particles are in the size range of U.S. Standard Mesh Size 50 or smaller. The coarse powder to powder size range encompasses, for example, the size range of 50–200 U.S. Standard Mesh Size. While larger particles may be used such as a fine granular size range of 30–35 U.S. Standard Mesh Size and smaller, the powder size range from coarse powder to powder best preserves overall tactile sensitivity through the layer of flexible elastic material. At the same time, the powder size range presents a sufficient distribution of reflective and dispersive surfaces for dispersing an incident laser beam in all directions without transmissive laser burn injuries and without dangerous reflections.

In the preferred embodiment of the invention, the density distribution of optically reflective and dispersive particles is non-homogeneous. That is, the density distribution of dispersive particles varies across the area of the glove. To achieve the dual objectives of protecting the hand from laser burn injuries and maintaining tactile sensitivity, for example, a higher density of dispersive particles is formed in the composite material of the back and palm of the hand. A lower density distribution of dispersive particles is formed in the fingers and in particular the finger tips, where laser injuries are less likely in any event, in order to preserve tactile sensitivity. The variable density distribution is achieved by forming composite material of different particle distribution densities at different discrete surface area portions of the glove, or by distributing the particles in a density gradient for example higher density at the back of the hand to lower density at the tips of the fingers.

According to another embodiment of the glove, the composite material layer according to the invention as described above may be sandwiched between additional laminated outer layers of the flexible elastic material. Only the center composite material layer includes the distributed and embedded optically reflective and dispersive particles. The outer layers of flexible elastic material such as latex, synthetic rubber or plastic do not contain the optically reflective and dispersive particles and are bonded to the central layer further enclosing the composite material particles.

In yet another embodiment of the invention the glove is formed with first and second layers of flexible elastic material such as latex, synthetic rubber or plastic. Over one of the elastic layers an adhesive layer may be formed and the optically reflective and dispersive particles are distributed in the desired density in the adhesive on the first elastic layer. The first and second elastic layers are then bonded together with the particles in the desired density distribution sandwiched between the bonded or laminated layers of flexible elastic material.

In each of the multi-layer or sandwich embodiments of the invention, the layers are formed so that the multiple composite layers still preserve tactile sensitivity through the multiple layers. Furthermore in the multilayer embodiments of the invention the density distribution of optically reflective and dispersive particles may similarly be varied in discrete areas across the area of the glove or through density gradients. As heretofore described the higher density distribution of particles is used to protect the back and palm of the hand, sites of more frequent laser burn injuries. The lower density is reserved for the fingers and in particularly the tips of the fingers for maintaining tactile sensitivity.

In the various multi-layer or sandwich embodiments of the invention the dispersive particles may similarly be selected from the class of optically reflective and dispersive particles such as metal filings, and particles of quartz, salts and ceramic materials. Similarly the preferred size range is in the coarse powder to powder size range of approximately 50 U.S. Standard Mesh Size or smaller for maintaining flexibility and tactile sensitivity.

Another feature of the composite material composition of the gloves of the present invention is that the dispersive particles are always embedded, encased or enclosed within non-porus flexible elastic material such as latex, synthetic rubber or plastic. The gloves according to the present invention are therefore formed with surfaces that are easily sterilized. Another feature of the invention is that the protective glove composite material works effectively in the infra red and near infra red laser beam frequency ranges as well as the optical frequency ranges for protecting the hands of workers using both infra red and optical lasers.

To achieve full embedding and encasement of the dispersive particles in a layer of flexible elastic material, the composite material is formed during preparation of the liquid latex, synthetic rubber, or plastic resin and prior to molding and curing of the rubber gloves. The desired density distribution of particles in the final molded product is achieved during molding by the density distribution of particles in the liquid resin injected in the mold. In the case of blow molding, density distribution can also be achieved according to the distribution of differential expansion of composite material in the mold.

Other objects, features and advantages of the invention are apparent in the following specification and accompanying drawings.

DESCRIPTION OF PREFERRED EXAMPLE EMBODIMENTS AND BEST MODE OF THE INVENTION

Figure 1:
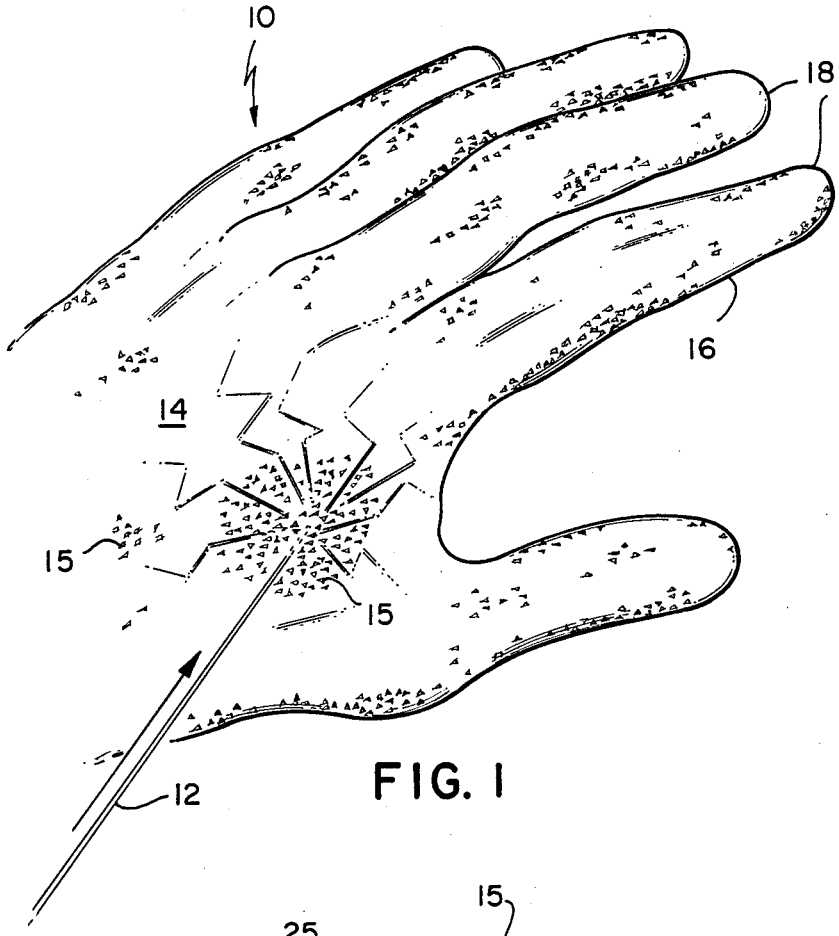
FIG. 1 is a perspective view of a protective glove according to the invention protecting the hand of a wearer by dispersion of laser beam incident on the back of the hand.

A protective glove 10 is shown in FIG. 1 protecting the hand of a wearer by omnidirectional dispersion of a laser beam 12 incident on the back 14 of the wearer's hand. The glove is formed by a layer of latex or other elastic synthetic rubber or plastic material which affords tactile sensitivity for medical, laboratory and industrial procedures requiring the use of protective gloves. Particles 15 of aluminum in the coarse powder size range of approximately 50–100 U.S. Standard Mesh Size and smaller are embedded within the latex. The particles are entirely covered and encased by the latex or other synthetic plastic material so that the glove presents a continuous non-porous surface over its entire surface area for sterilization.

Figure 2A:
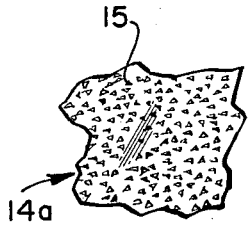
FIG. 2A is a fragmentary detail plan view showing a composite material patch of higher density distribution of dispersive particles in the area of the back of the hand of the glove.
Figure 2B:
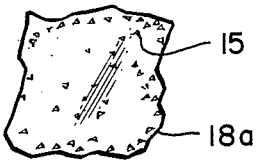
FIG. 2B is a fragmentary plan view showing a composite material patch of lower density distribution of dispersive particles in the area of the fingers of the glove approaching the finger tips.
Figure 3:
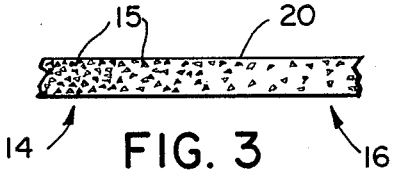
FIG. 3 is a diagrammatic side view showing a nonhomogeneous or an isotropic density distribution of dispersive particles from a higher density on the left in the vicinity, for example, of the back of the hand, to a lower density on the right approaching the tips of the fingers.

The coarse powder size aluminum particles 15 are distributed and embedded within the latex layer of the back 14 and palm of the glove 10 at a greater density than in the fingertips as shown in the detailed fragmentary patch **14*a* of FIG. 2A taken from the back 14 of the glove 10. The particle distribution density in the elastic material layer of the fingers 16 and particularly the tips 18 of the fingers 16 is at a lower distribution density sufficient to preserve tactile sensitivity as shown in the detailed fragmentary patch 18*a* of FIG. 2B taken from a fingertip 18 of glove 10. Alternatively, the particle distribution density may vary along a gradient from higher density at the back 14 of the hand to a lower density along the fingers 16 to the fingertips 18 as shown in FIG. 3**.

The density of particles 15 in the higher density portions of the glove 10, such as for example the back 14 and palm of the glove is selected and adjusted so that transmission or transmissivity of a laser beam through the composite layer is substantially attenuated to for example less than 10% of the incident laser beam light energy. Since a variety of different optically reflective and dispersive particulate materials may be used as the filler in the matrix layer of latex or other synthetic rubber or plastic material, the desirable density of the particles may be readily determined empirically. One method for determining desired density is to direct a laser beam through the composite material layer. Attenuation is measured using infra-red radiation detectors positioned for measuring light transmitted through the composite material layer and light reflected from the layer in different directions. The incident radiation which is not transmitted through the composite material layer is attenuated by omnidirectional dispersion from the randomly distributed and oriented facets and irregular surfaces of the optically reflective and dispersive particles.

Figure 4:
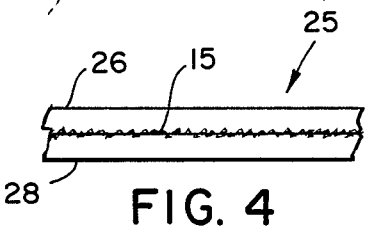
FIG. 4 is a fragmentary diagrammatic side view of a two layer sandwich composite material for forming the laser beam dispersive reflective glove.

An alternative glove construction is illustrated in FIG. 4 where the composite material layer 25 is formed by first and second layers 26, 28 of latex or other synthetic rubber or plastic material bonded together with the optically reflective and dispersive particles 15 "sandwiched" and bonded between the layers. To form the configuration of FIG. 4, for example, an adhesive layer is formed over the elastic material layer 28 and the dispersive particles 15 are distributed on the adhesive layer in the desired density. The second elastic material layer 26 is then bonded over the first elastic material layer 28, laminating the layers together and sealing and sandwiching the particles 15 between the layers. The thickness of the elastic material layers 26, 28 is selected to achieve the desired sensitivity through the overall laminated composite layer 25.

Figure 5:
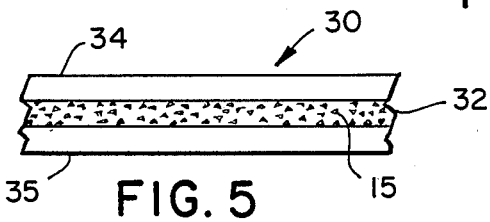
FIG. 5 is a three layer sandwich composite material for forming the laser dispersive protective glove.

Another glove construction is illustrated by the multi-layer composite material layer 30 of FIG. 5. In this construction, the glove sheath or skin material is formed by a central composite material layer 32 such as, for example, the composite material layer 20 of FIG. 3, with outer layers 34 and 35 bonded to either side of the central composite material layer 32. Again, the thickness of the respective layers 32, 34 and 35 is selected so that the composite layer 30 achieves or preserves the desired tactile sensitivity. In this example it is the central layer 32 of the multi-layer sandwich that attenuates incident laser beam energy by omnidirectional dispersion.

While the invention has been described with reference to particular example embodiments it is intended to cover all modifications and equivalents within the scope of the following claims.

We claim:

1. A protective glove comprising:

a glove formed of composite material for close fitting over the fingers and the back and palm of the hand, said composite material comprising a layer of flexible elastic material for tactile sensitivity through the layer, and optically reflective and dispersive particles distributed and embedded within said layer for dispersing incident laser light for avoiding laser burn injuries to the hand of a wearer.

2. The protective glove of claim 1 wherein the dispersive particles comprise metal filings.

3. The protective glove of claim 2 wherein the metal filings comprise aluminum filings.

4. The protective glove of claim 1 wherein the dispersive particles comprise non-metallic mineral particles.

5. The protective glove of claim 1 wherein the dispersive particles comprise ceramic powder particles.

6. The protective glove of claim 1 wherein the dispersive particles are in the size range of coarse powder to powder size particles.

7. The protective glove of claim 6 wherein the dispersive particles are in a size range of approximately 50–100 U.S. Standard Mesh Size.

8. The protective glove of claim 7 wherein the dispersive particles are in a size range of approximately 50 U.S. Standard Mesh Size and smaller.

9. The protective glove of claim 1 wherein the composite material layer comprises a center layer and further comprising outer layers of flexible elastic material bonded to the composite material center layer in a sandwich configuration on either side of the composite material center layer.

10. The protective glove of claim 1 wherein the dispersive particles are distributed and embedded in the layer of flexible elastic material with a relatively higher density distribution in the area of the back and palm of the hand of the glove and with a relatively lower density distribution in the area of the fingers of the glove.

11. The protective glove of claim 1 wherein the dispersive particles are distributed and embedded within the layer of flexible elastic material with a density gradient generally from a higher density distribution in the vicinity of the back and the palm of the hand to a lower density distribution in the vicinity of the fingers.

12. A protective glove comprising:

a glove formed of composite material for close fitting over the fingers and the back and palm of the hand, said composite material comprising first and second layers of flexible elastic material bonded together, said first and second layers being formed to provide tactile sensitivity through the composite layer, and optically reflective and dispersive particles distributed and bonded between the first and second layers for dispersing incident laser light thereby preventing laser burn injuries to the hand of a wearer.

13. The protective glove of claim 12 wherein the dispersive particles comprise metal filings.

14. The protective glove of claim 13 wherein the metal filings comprise aluminum filings.

15. The protective glove of claim 12 wherein the dispersive particles comprise ceramic particles in the coarse powder to powder size range.

16. The protective glove of claim 12 wherein the dispersive particles are substantially in the size range of coarse powder to powder.

17. The protective glove of claim 16 wherein the dispersive particles are in the size range of approximately 50 U.S. Standard Mesh Size.

18. The protective glove of claim 12 wherein the dispersive particles are distributed and bonded between the first and second layers of flexible elastic material with a relatively higher density distribution in the area of the back and palm of the hand and a relatively lower density distribution in the fingers.

19. The protective glove of claim 18 wherein the dispersive particles are distributed and bonded between the first and second layers of flexible elastic material with a density gradient from a higher density in the area of the back and the palm of the hand to a lower density at the tips of the fingers.

* * * * *